US006734825B1

(12) United States Patent
Guo et al.

(10) Patent No.: US 6,734,825 B1
(45) Date of Patent: May 11, 2004

(54) MINIATURE BUILT-IN MULTIPLE FREQUENCY BAND ANTENNA

(75) Inventors: Yongxin Guo, Singapore (SG); Yan Wah Michael Chia, Singapore (SG); Zhining Chen, Singapore (SG)

(73) Assignee: The National University of Singapore, Singapore (SG)

( * ) Notice: Subject to any disclaimer, the term of this patent is extended or adjusted under 35 U.S.C. 154(b) by 30 days.

(21) Appl. No.: 10/281,226

(22) Filed: Oct. 28, 2002

(51) Int. Cl.[7] ..... H01Q 1/38

(52) U.S. Cl. ..... 343/700 MS; 343/702; 343/893

(58) Field of Search ..... 343/700 MS, 702, 343/745, 846, 848, 847, 893

(56) References Cited

U.S. PATENT DOCUMENTS

| | | | | |
|---|---|---|---|---|
| 6,166,694 | A | 12/2000 | Ying | 343/702 |
| 6,343,208 | B1 | 1/2002 | Ying | 455/90 |
| 6,552,686 | B2 * | 4/2003 | Ollikainen et al. | 343/700 MS |
| 6,614,399 | B2 * | 9/2003 | Trumbull et al. | 343/702 |
| 6,639,560 | B1 * | 10/2003 | Kadambi et al. | 343/700 MS |
| 6,650,294 | B2 * | 11/2003 | Ying et al. | 343/700 MS |
| 6,650,295 | B2 * | 11/2003 | Ollikainen et al. | 343/700 MS |
| 2002/0019247 | A1 | 2/2002 | Egorov | 455/557 |

FOREIGN PATENT DOCUMENTS

WO WO 01/91233 A1 11/2001

OTHER PUBLICATIONS

Zi Dong Liu et al., Oct. 1997: "Dual–Frequency Planar Inverted–F Antenna", in IEEE Transactions on Antennas and Propagation, vol. 45, No. 10, pp. 1451–1458.

* cited by examiner

*Primary Examiner*—Shih-Chao Chen
(74) *Attorney, Agent, or Firm*—Nath & Associates PLLC; Harold L. Novick

(57) ABSTRACT

A multiple frequency band antenna is disclosed involving a first resonant portion tuned to a low frequency band; a second resonant portion tuned to a first high frequency band at frequencies higher than the low frequency band; a third resonant portion tuned to a second high frequency band at frequencies higher than the low frequency band and substantially different from the first high frequency band; and a first conductor portion forming part of the first resonant portion and the second resonant portion, the first conductor portion having a grounding point, a feeding point for providing an input signal to at least one of the first resonant portion and the second resonant portion and for receiving an output signal from at least one of the first resonant portion and the second resonant portion, and a second conductor portion electrically connected to the feeding point wherein the third resonant portion is electrically connected to the second conductor portion.

21 Claims, 7 Drawing Sheets

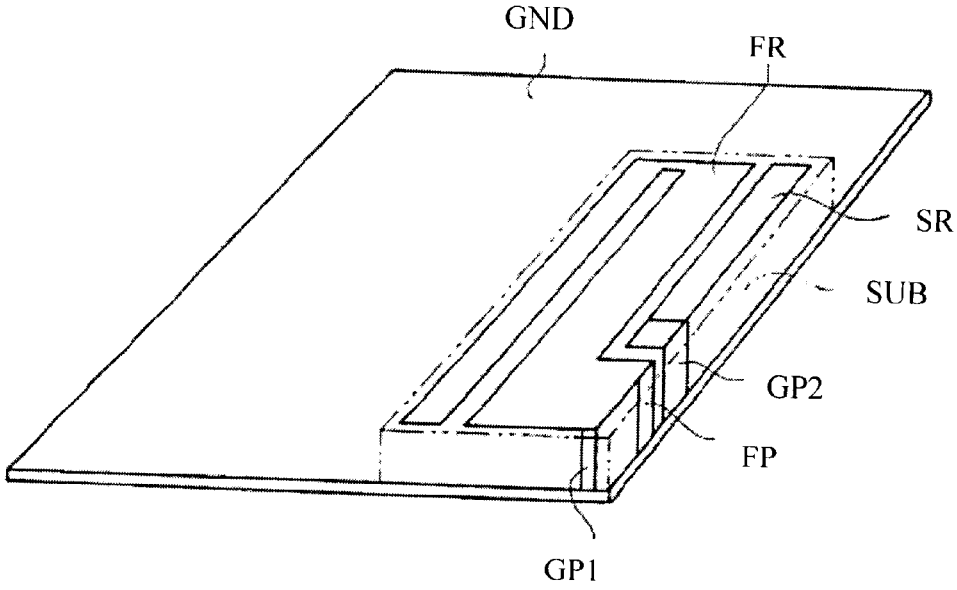
Figure 1 – Prior Art
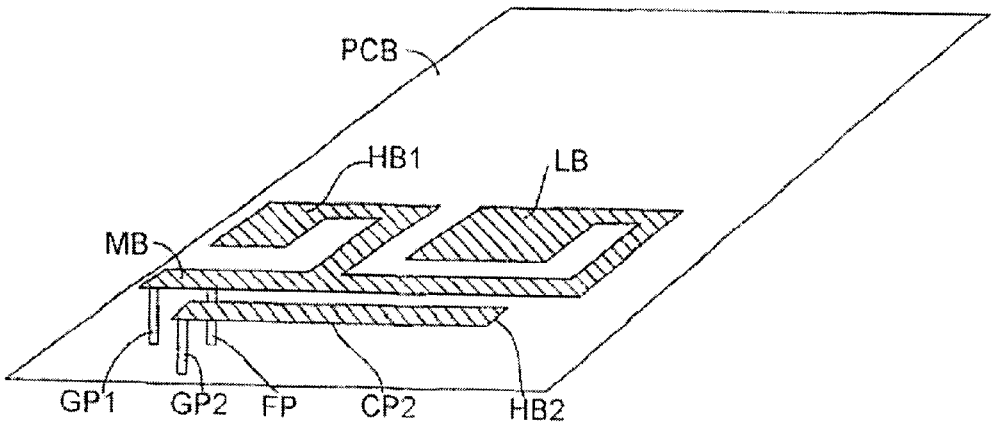
Figure 2 – Prior Art

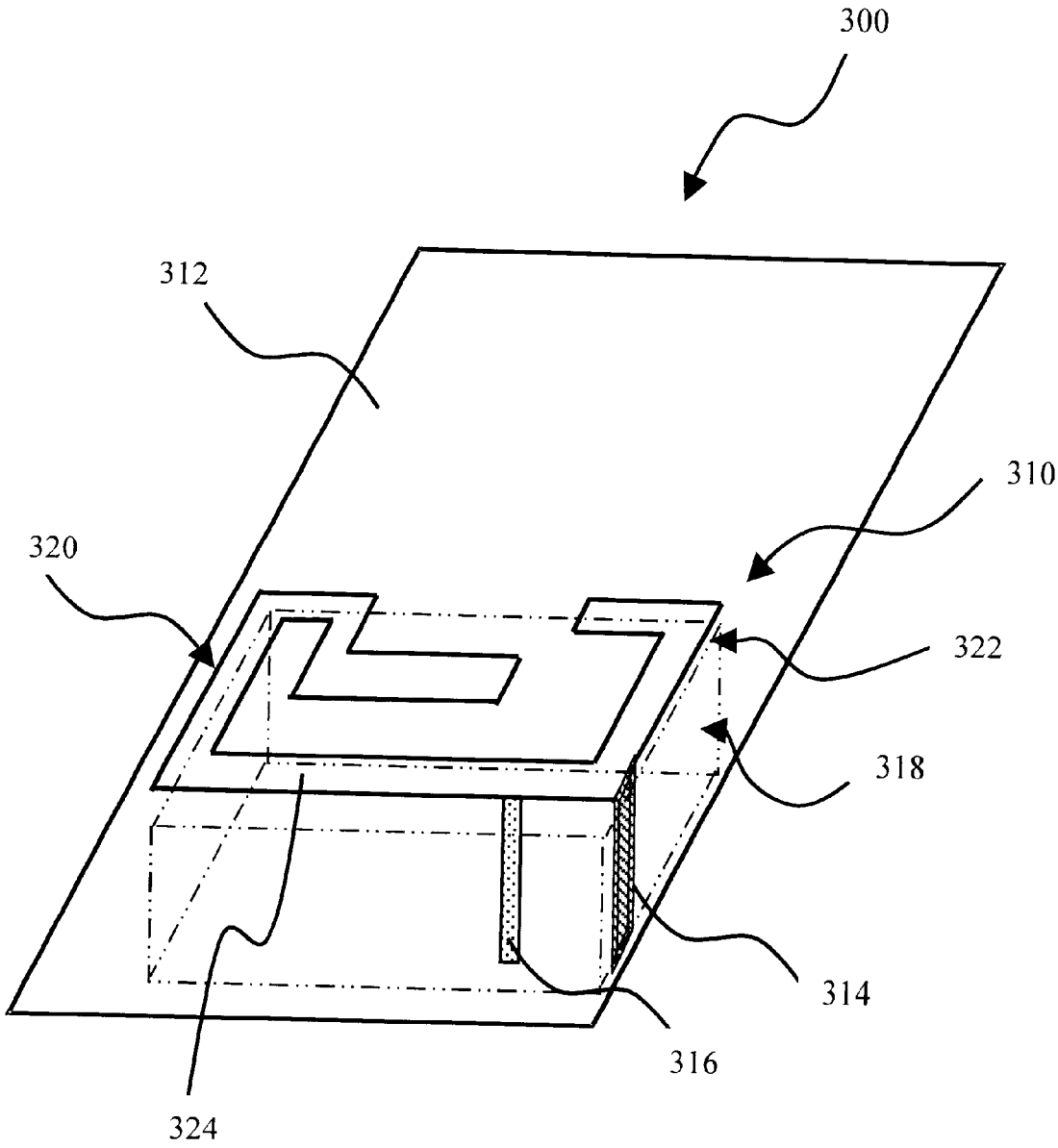
Figure 3 – Prior Art

MINIATURE BUILT-IN MULTIPLE FREQUENCY BAND ANTENNA

FIELD OF INVENTION

The invention relates generally to radio communication systems. In particular, the invention relates to built-in antennas for radio communication devices for enabling the radio communication devices to perform radio communication in different radio frequency bands.

BACKGROUND

Presently, many antennas, such as monopole antennas or helical antennas, for radio communication devices, such as mobile phones, are mounted directly onto the chassis of radio communication devices. However, as the sizes and weights of such radio communication devices continue to decrease because of advancing research and development, such monopole or monopole-like antennas become more of a hindrance than advantage due to the inherent sizes. Additionally, as the functionality of these radio communication devices expands rapidly, the need arises for built-in miniature antennas that are capable of being resonant at multiple frequency bands.

Conventional built-in antennas currently used in mobile phones include microstrip antennas, wire-form shaped inverted-F antennas (IFA), and planar inverted-F antennas (PIFA). Microstrip antennas are small in size and light in weight. However, at lower radio frequency bands for mobile communication applications, such as the GSM900 band centred on the radio frequency 900 MHz, microstrip antennas become too large for incorporation into a mobile phone. As an alternative, the planar inverted-F antenna (PIFA) can be implemented in a mobile phone, as proposed by Q. Kassim in "Inverted-F Antenna for Portable Handsets", IEE Colloquium on Microwave Filters and Antenna for personal Communication systems, pp.3/1–3/6, February 1994, London, UK. Such a conventional PIFA, which has a length equal to a quarter wavelength of the centre or operating frequency of the radio frequency band of interest, however operates in a narrow frequency range.

In addition to reduced antenna sizes, it is envisaged that next generation mobile phones require the capability to tune to a number of radio frequency bands for cellular applications, wireless local area networking applications and other radio communication applications. Dual-frequency band PIFA radiating elements are therefore proposed in "Dual-frequency planar inverted-F antenna" by Z. D. Liu, P. S. Hall, and D. Wake, IEEE Trans AP, vol.45, no.10, pp.1451–1457, October 1997. Such dual-frequency band antennas utilise two feeding points and share a common feeding point, respectively, and are associated with either complicated feeding structures or narrow bandwidths.

In U.S. Pat. No. 6,166,694 entitled "Printed Twin Spiral Dual Band Antenna", a multiple frequency band, built-in antenna is proposed that is suitable for future generations of mobile phones. This built-in antenna comprises two spiral conductor and resonant arms that are of different lengths and capable of being tuned to different frequency bands. In order to increase the bandwidth of such an antenna, a resistor loading technique is introduced. However, the improvement in bandwidth is obtained at the expense of antenna gain of such a built-in antenna.

Currently, many mobile phones operate in one or more of the following three frequency bands: the GSM band centred on the radio frequency 900 MHz, the DCS band centred on the radio frequency 1800 MHz, and the PCS band centred on the radio frequency 1900 MHz.

In U.S. Pat. No. 6,343,208 entitled "Printed Multi-Band Patch Antenna", a built-in patch antenna is proposed which includes patch elements of different sizes that are capable of being tuned to different frequency bands. Such an antenna experience problems tuning to multiple frequency bands while simultaneously having a broad bandwidth in each of the multiple frequency bands.

More recently, triple-band built-in antennas at operational at the GSM/DCS/PCS bands as shown in FIGS. 1 and 2 are proposed in PCT application number WO01/91233 and U.S. patent application Ser. No. 09/908,817, respectively. These antennas include a main radiator operating at a low frequency band and a first high band and a shorted parasitic radiator operating at a second high band. The parasitic radiator lies in the same plane with the main radiator and therefore occupies valuable space in mobile phones that are constantly shrinking in size. Moreover, the parasitic-feed technique used for the additional parasitic radiator may have problems in tuning of the parasitic radiator. In practice, for the parasitic-feed technique, it is difficult to tune the parasitic radiator because of the mutual coupling between antenna elements. Tuning one resonant frequency adversely changes another resonant frequency simultaneously.

In respect of the foregoing proposed antennas, a number of problems still exist. Firstly, the sizes of the prior art antennas are still large. Secondly, there is a trend for built-in antennas used in radio communication devices providing quad-frequency band operations to cover GSM900, DCS1800, PCS1900 and 3G bands. Additionally, it is not unforeseeable for these radio communication devices to provide five-frequency band operations to cover the GSM900, DCS1800, PCS1900, 3G and ISM2450 bands simultaneously. Existing built-in antennas are however unable to cover these frequency bands simultaneously.

Thirdly, these antennas have problems tuning to multiple frequency bands while simultaneously having a broad bandwidth in each of these multiple frequency bands. Finally, the parasitic-feed technique used for additional parasitic radiators may have problems in tuning the matching of the parasitic radiators. In practice, for the parasitic-feed technique, it is difficult to perform tuning because of the mutual coupling between antenna elements. Tuning of one resonant frequency changes another resonant frequency simultaneously.

There is therefore a need for a built-in antenna for addressing the foregoing problems.

SUMMARY

In accordance with an aspect of the invention, there is provided a multiple frequency band antenna comprising:

- a first resonant portion tuned to a low frequency band;
- a second resonant portion tuned to a first high frequency band at frequencies higher than the low frequency band;
- a third resonant portion tuned to a second high frequency band at frequencies higher than the low frequency band and substantially different from the first high frequency band; and
- a first conductor portion forming part of the first resonant portion and the second resonant portion, the first conductor portion having
  - a grounding point,
  - a feeding point for providing an input signal to at least one of the first resonant portion and the second resonant portion and for receiving an output signal from at least one of the first resonant portion and the second resonant portion, and a second conductor portion electrically connected to the feeding point wherein the third resonant portion is electrically connected to the second conductor portion.

BRIEF DESCRIPTION OF THE DRAWINGS

Embodiments of the invention are described in greater detail hereinafter with reference to the drawings, in which:

FIGS. 1–3 illustrate various prior art multiple frequency band antennas;

DETAILED DESCRIPTION

Figure 4:
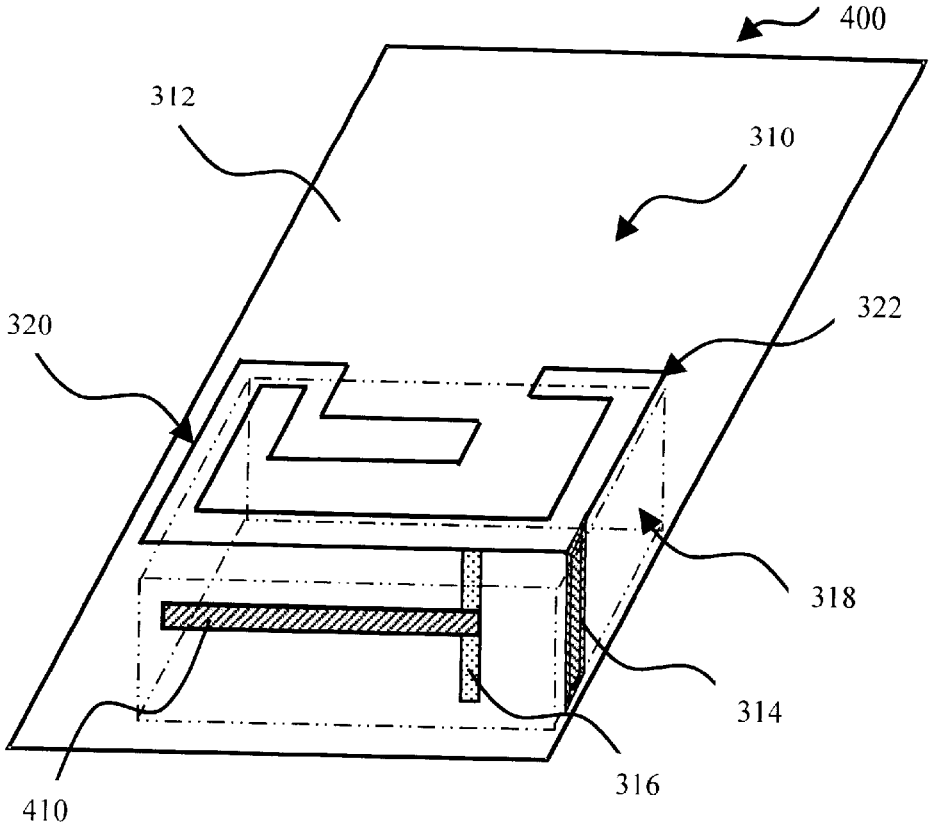
FIG. 4 illustrates a three-resonator antenna according to an embodiment of the invention for achieving a quad-frequency band operation.

To address the foregoing problems, embodiments of the invention are described hereinafter in relation to built-in antennas that can efficiently provide radio communication coverage at triple-, quad- and five-frequency band operations. The return loss and radiation performances of these antennas are investigated through measurements and simulations that are based on a commercial software, namely XFDTD5.3.

In accordance with a first embodiment of the invention, a three-resonator antenna is described. A metal strip or the like conductor as an additional resonator is directly connected to a feed strip and positioned at a plane perpendicular to a ground plane and a main dual-resonator patch radiator. As an example, a quad-frequency band antenna for covering the GSM900, DCS1800, PCS1900 and 3G bands is achieved based on an antenna design concept. By further using the antenna design concept, the three-resonator antenna can be extended to form a four-resonator antenna in accordance with a second embodiment of the invention for achieve a five-frequency band operation to cover the GSM900, DCS1800, PCS1900, 3G and ISM2450 bands. This is done by the addition of a second metal strip or the like conductor connected to the feed strip.

Other embodiments of the invention having different configurations of the three- and four-resonator antennas are also described. In such three- and four-resonator antennas, the foregoing problem relating to the parasitic-feed technique for an additional resonator in a conventional multiple frequency band antenna can be alleviated.

There are a number of distinctions between the multi-resonator antennas according to embodiments of the invention and conventional multiple frequency band antennas. Firstly, an additional resonator in an embodiment antenna is directly connected to a feed strip of the embodiment antenna, while, in the case of a conventional multiple frequency band antenna, an additional resonator is a parasitic element without direct connection to a feed strip.

Furthermore, the additional resonator in-the embodiment antenna is positioned on a plane generally perpendicular to a ground plane and a main dual-resonator patch radiator in the embodiment antenna. In the conventional multiple frequency band antenna, however, the additional parasitic resonator connected to a ground plane via a shorting pin is separated or displaced from a main dual-resonator patch radiator and positioned in a plane generally parallel to the ground plane and the main dual-resonator patch radiator.

The embodiment antennas are suitable for use in radio communication systems, for e.g. portable communication devices such as mobile phones. These antennas are useful for providing radio communication in a low frequency band and multiple high frequency bands. A mobile phone or the like portable communication device having such an antenna can thus perform radio communication in three, four or five frequency bands such as the foregoing GSM900, DCS1800, PCS1900, 3G and ISM2450 bands centred on 900 MHz, 1800 MHz, 1900 MHz, 2000 MHz, and 2450 MHz respectively. However, the embodiment antennas are not restricted to use in these frequency bands, but can be suitably used in other existing and future frequency bands as well.

The antenna design concept for the embodiment antennas involves a direct-feed technique rather than a parasitic-feed technique as applied in the conventional multiple frequency band antenna, as a result of which improves the bandwidth of the embodiment antennas. Using this antenna design concept, the tuning of the embodiment antennas becomes an easy process. The embodiment antennas can therefore be tuned at multiple-frequency bands simultaneously thus having a broad bandwidth in each of these multiple frequency bands. In the conventional multiple frequency band antennas, however, the parasitic-feed technique used for the additional resonator experience inherent problems. In practice, it is difficult to tune the conventional multiple frequency band antennas using the parasitic-feed technique because of the mutual coupling between antenna elements. Tuning of one resonant frequency changes another resonant frequency simultaneously.

Advantageously, the size of the embodiment antennas can be reduced by an order of 10~20% for a three-resonator antenna as compared to the conventional multiple frequency band antennas, which is desirable since the size of mobile phones is becoming smaller according to consumer preferences.

FIG. 3 shows a conventional two-resonator PIFA 300 for dual-frequency band operation, which is preferably used as a starting point for the antenna design concept. Such a conventional antenna 300 comprises a folded radiating patch 310 or the like resonant structure positioned on a first layer, a ground plane 312 or the like ground conductor positioned on a second layer, a short-circuit ground strip 314 or the like conductor, and a feed strip 316 or the like conductor. The folded radiating patch 310 is positioned on one side of the ground plane 312 and is connected to the ground plane 312 via the short-circuit ground strip 314 and fed via the feed strip 316 that is connected to a transmission line in turn connected to an electronic circuit (both not shown) positioned on the reverse side of the ground plane 312. The folded radiating patch 310 is spaced from the ground plane 312 by a dielectric substrate 318 such as foam. On the first layer, the folded radiating patch 310 includes a long meandering portion 320 or the like resonant portion that is tuned to have a relatively low resonance frequency, such as 900 MHz, and a short spiral portion 322 or the like resonant portion is tuned to have a high resonance frequency, such as 1800 MHz. Both the long meandering portion 320 and the short spiral portion 322 share a common antenna portion 324 or the like conductor on which the length of the respective resonant portion is dependent for operation.

In the conventional two-resonator PIFA 300, the short-circuit ground strip 314 and the feed strip 316 are preferably rectilinear. The feed strip 316 is preferably positioned generally perpendicular or orthogonal to both the first and second layers of the conventional two-resonator PIFA 300. However, in variations of the conventional two-resonator PIFA 300 the feed strip 316 may be tilted with respect to the first and second layers of the conventional two-resonator PIFA 300. The feed strip 316 is connected to the folded radiating patch 310 at a feed point along the common antenna portion 324 and the short-circuit ground strip 314 is connected to the folded radiating patch 310 at a ground point at the end of the common antenna portion 324 that forms part of the short spiral portion 322.

In the folded radiating patch 310, the long meandering portion 320 is also preferably formed from five rectilinear segments forming right angles with each other in a meandering pattern, the first rectilinear segment being part of the common antenna portion 324 stemming from the feed point distal to the ground point. The first four rectilinear segments form a spiral while the end rectilinear segment forms a right angle away from the spiral. The short spiral portion 322 is also preferably formed from three rectilinear segments forming right angles with each other in a spiralling pattern, the first rectilinear segment being part of the common antenna portion 324 stemming from the feed point proximal to the ground point, the three rectilinear segments of the short spiral portion 322 spiralling in an orientation opposite the spiral formed by the first four rectilinear segments of the long meandering portion 320.

The long meandering portion 320 is tuned to have a relatively low resonance frequency, such as 900 MHz, and a predefined bandwidth to define a low frequency band of the conventional two-resonator PIFA 300. The low resonance frequency is mainly determined or influenced by the length of the long meandering portion 320 measured from the feeding point to the inner end of the long meandering portion 320, which length corresponds to one quarter of a wavelength at the low resonance frequency. When an electrical signal with frequencies in the low frequency band is fed to the feeding point of the conventional two-resonator PIFA 300, corresponding electromagnetic signals are radiated from the long meandering portion 320 of the conventional two-resonator PIFA 300 as radio waves; and, vice versa, when the conventional two-resonator PIFA 300 receives electromagnetic signals in the form of radio waves with frequencies in the low frequency band, electrical signals are generated by the long meandering portion 320 of the conventional two-resonator PIFA 300, and the thus generated electrical signals are sensed at the feed strip 316 by receiving electronic circuitry connected to the conventional two-resonator PIFA 300.

The short spiral portion 322 of the conventional two-resonator PIFA 300 is tuned to have a first high resonance frequency, such as 1800 MHz, and predefined bandwidth to define a first high frequency band. The first high resonance frequency is mainly determined or influenced by the length of the short spiral portion 322 measured from the feeding point to the inner end of the short spiral portion 322, which length corresponds to one quarter of a wavelength at the first high resonance frequency. When an electrical signal with frequencies in the first high frequency band is fed to the feeding point of the conventional two-resonator PIFA 300, corresponding electromagnetic signals are radiated from the short spiral portion 322 of the conventional two-resonator PIFA 300 as radio waves, and, vice versa, when the conventional two-resonator PIFA 300 receives electromagnetic signals in the form of radio waves with frequencies in the first high frequency band, electrical signals are generated by the short spiral portion 322 of the conventional two-resonator PIFA 300, and the thus generated electrical signals are also sensed at the feed strip 316 by receiving electronic circuitry connected to the conventional two-resonator PIFA 300.

Together, the long meandering portion 320 and the short spiral portion 322 of the conventional two-resonator PIFA 300 form the folded radiating patch 310 that is essentially a dual band radiating patch which is usable in mobile telephones operating in two frequency bands such as 900 MHz and 1800 MHz.

A three-resonator antenna 400 according to a first embodiment of the invention is shown in FIG. 4. Such an antenna 400 includes the conventional two-resonator PIFA 300 and a first additional radiating strip 410 or the like resonant structure. The first additional radiating strip 410 is directly connected to the feed strip 316 and preferably is rectilinear lying on a plane on which the feed strip 316 lies and generally perpendicular to the folded radiating patch 310 and the ground plane 312. In a conventional multiple frequency band antenna, however, a parasitic strip connected to a ground plane via a shorting pin is displaced at a distance from the main dual-resonator patch radiator with the parasitic strip being parallel to the ground plane and coplanar with the main dual-resonator patch radiator. As is well known, the size of multiple frequency band antennas is very critical in miniature built-in antenna designs. Thus, the three-resonator antenna 400 can have an advantage in size reduction over the conventional antenna designs. The first additional radiating strip 410 behaves like an inverted-F antenna (IFA) and is tuned to have a second high resonance frequency, such as 2100 MHz. The second high resonance frequency is mainly determined or influenced by the length of the first additional radiating strip 410 measured from the point to which the first additional radiating strip 410 is connected to the feed strip 316 to the free end of the first additional radiating strip 410, which length corresponds to one quarter of a wavelength at the second high resonance frequency. By doing this, the operational frequency range of the three-resonator antenna 400 is extended to cover the 3G band, namely from 1.885 to 2.2 GHz.

Figure 5:
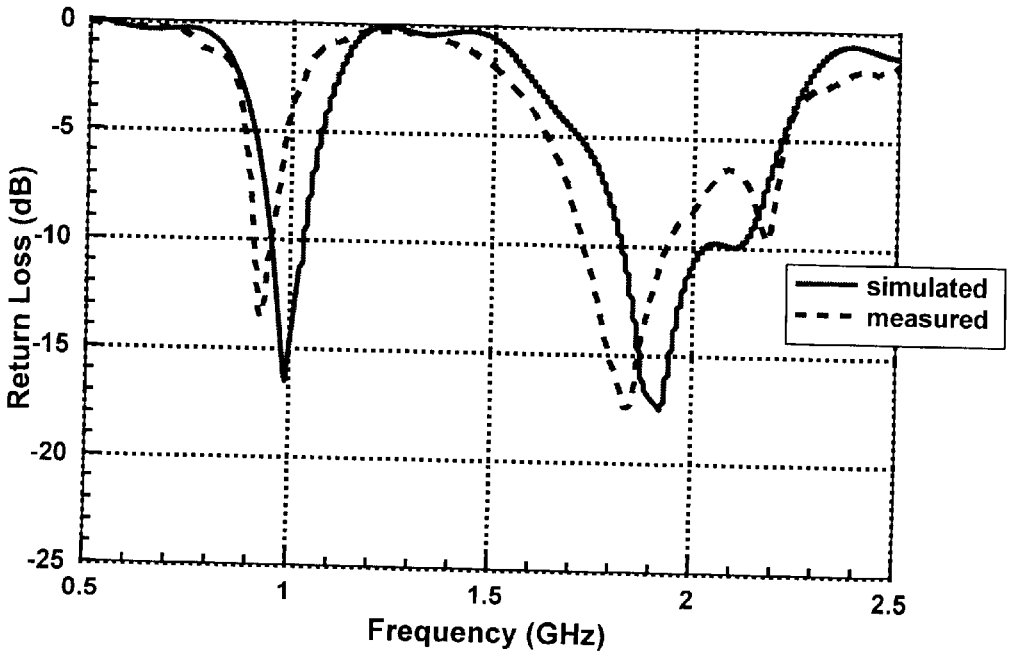
FIG. 5 illustrates results of a simulation and a measurement of the return loss of the quad-band antenna of FIG. 4.

FIG. 5 shows measured and simulated return loss results of the three-resonator antenna 400 to achieve quad-frequency band operation. The three-resonator antenna 400 is simulated and tested on a test board having a dimension of 80 mm by 40 mm. Both results are in good agreement. The measured bandwidths according to −6 dB return loss matching are 91 MHz (886–977 MHz) at the GSM900 band and 525 MHz (1685–2210 MHz) at the DCS1800, PCS1900, and 3G bands, respectively. The three-resonator antenna 400 has a capacity to cover the GSM900, DCS1800, PCS1900 and 3G bands. Each of the return loss results shown in FIG. 5 includes one distinct minimum at a low frequency band and two minima at two high frequency bands relatively close to each other. It is observed that the wide bandwidth of the higher band of the three-resonator antenna 400 is due to the first additional radiating strip 410 connected to the feed strip 316. The measured values of the gain for each frequency band are from 0 to 4 dBi.

Figure 6:
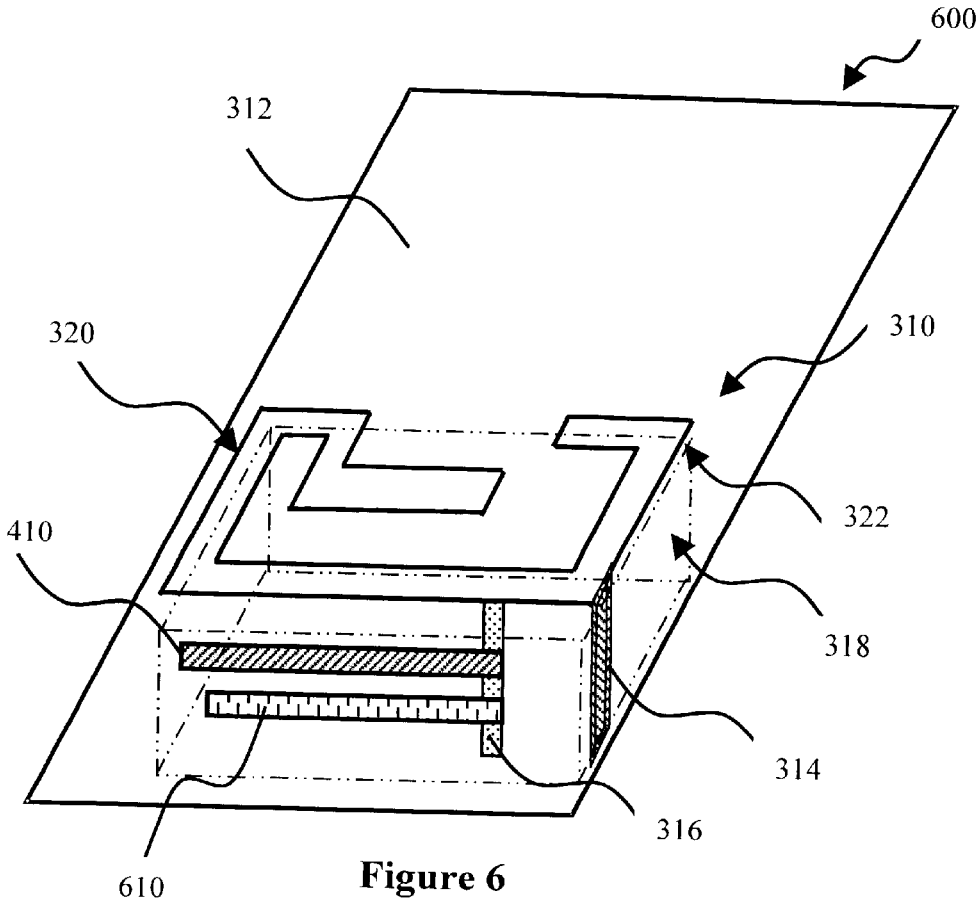
FIG. 6 illustrates a four-resonator antenna according to another embodiment of the invention for achieving five-frequency band operation.
Figure 7:
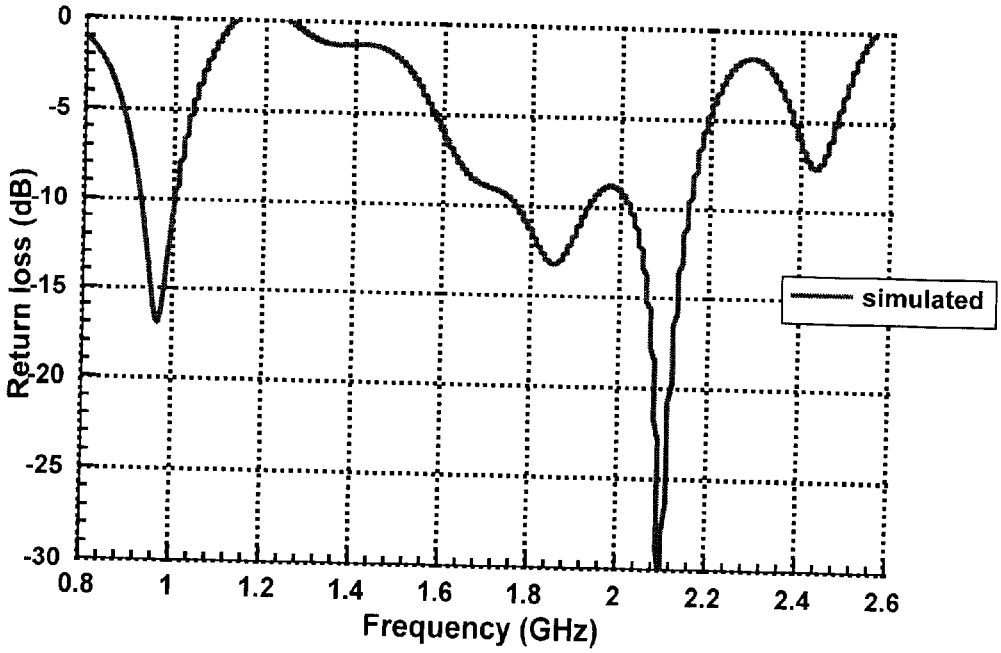
FIG. 7 illustrates results of a simulation of the return loss of the five-frequency band antenna of FIG. 6.

FIG. 6 shows a four-resonator antenna 600 according to a second embodiment of the invention for five-band operation by adding a second additional radiating strip 610 and connecting it to the feed strip 316. Essentially, the second additional radiating strip 610 lies in the same plane with and is parallel with the first additional radiating strip 410. The second additional radiating strip 610 is also positioned adjacent to the ground plane. As an example, the simulated return loss for such an antenna 600 is shown in FIG. 7. It is observed that the four-resonator antenna 600 can cover the GSM900, DCS1800, PCS1900, 3G and ISM2450 bands.

Such an antenna 600 includes the conventional two-resonator PIFA 300, the first additional radiating strip 410 or the like resonant structure, and the second additional radiating strip 610 or the like resonant structure. The first additional radiating strip 410 is directly connected to the feed strip 316 and preferably is rectilinear lying on the plane on which the feed strip 316 lies and generally perpendicular to the folded radiating patch 310 and the ground plane 312. Similarly, the second additional radiating strip 610 is directly connected to the feed strip 316 and preferably is rectilinear lying on the plane on which the feed strip 316 lies. The four-resonator antenna 600 can have an advantage in size reduction over the conventional antenna designs. The second additional radiating strip 610 behaves like an inverted-F antenna (IFA) and is tuned to have a third high resonance frequency, such as 2450 MHz. The third high resonance frequency is mainly determined or influenced by the length of the second additional radiating strip 610 measured from the point to which the second additional radiating strip 610 is connected to the feed strip 316 to the free end of the second additional radiating strip 610, which length corresponds to one quarter of a wavelength at the third high resonance frequency. By doing this, the operational frequency range of the four-resonator antenna 600 is extended to cover the ISM2450 band, namely from 2.40 to 2.48 GHz.

Figure 8:
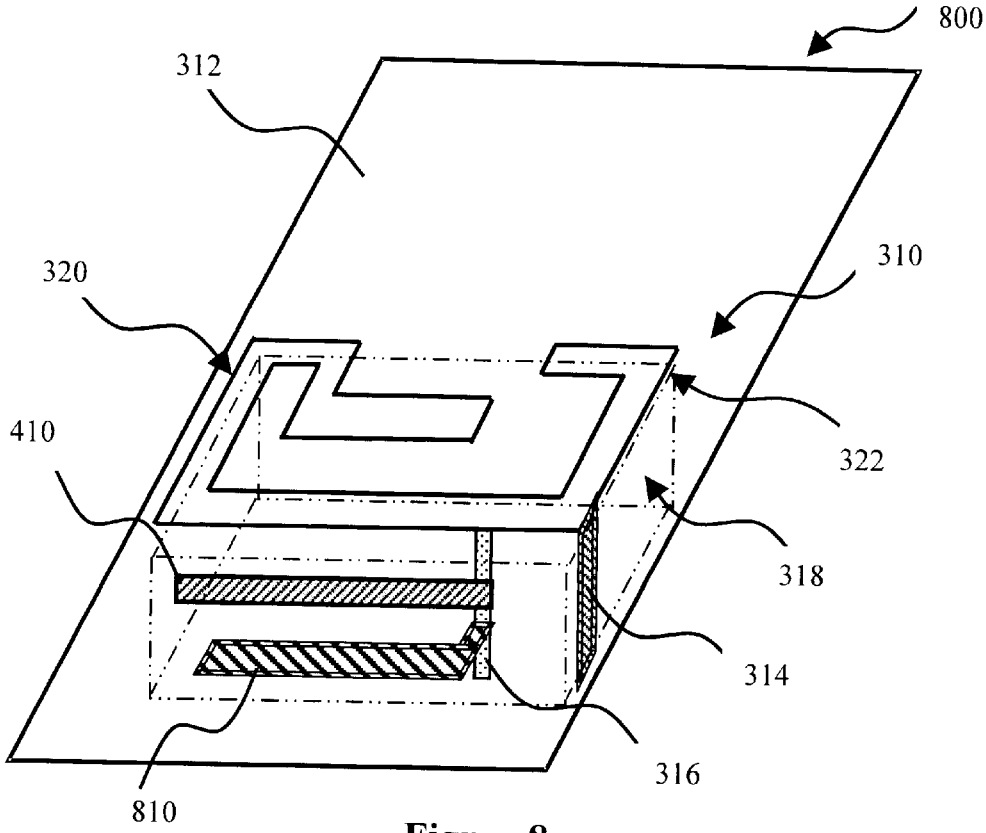
FIGS. 8–13 illustrate further embodiments of the invention for achieving multiple frequency band operations.

FIG. 8 shows another four-resonator antenna 800 according to a third embodiment of the invention for five-frequency band operation to cover the GSM900, DCS1800, PCS1900, 3G and ISM2450 bands by adding a second additional radiating strip 810 and connecting it to the feed strip 316. The second additional radiating strip 810 is, however, parallel to the ground plane 312 and the conventional two-resonator PIFA 300 but displaced from the first additional radiating strip 410 so that it is adjacent to the ground plane 312. The additional separation between the first additional radiating strip 410 and the second additional radiating strip 810 reduces mutual coupling therebetween and can fitted into a rounded casing at an end of a mobile phone.

Such an antenna 800 includes the conventional two-resonator PIFA 300, the first additional radiating strip 410 or the like resonant structure, and the second additional radiating strip 810 or the like resonant structure. The first additional radiating strip 410 is directly connected to the feed strip 316 and preferably is rectilinear lying on the plane on which the feed strip 316 lies and generally perpendicular to the folded radiating patch 310 and the ground plane 312. Similarly, the second additional radiating strip 810 is directly connected to the feed strip 316 and preferably is rectilinear lying on the plane parallel to the ground plane 312. The four-resonator antenna 800 can have an advantage in size reduction over the conventional antenna designs. The second additional radiating strip 810 behaves like an inverted-F antenna (IFA) and is tuned to have a third high resonance frequency, such as 2450 Mhz. The third high resonance frequency is mainly determined or influenced by the length of the second additional radiating strip 810 measured from the point to which the second additional radiating strip 810 is connected to the feed strip 316 to the free end of the second additional radiating strip 810, which length corresponds to one quarter of a wavelength at the third high resonance frequency.

Figure 9:
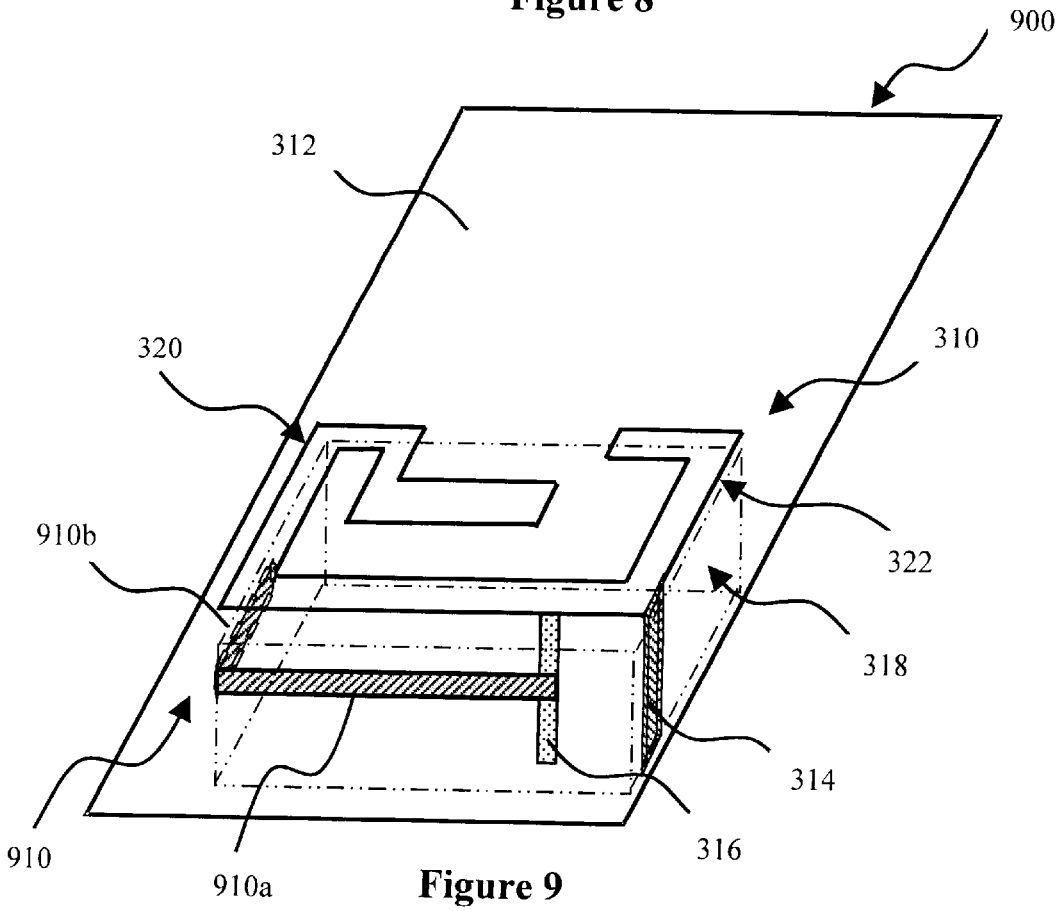

A three-resonator antenna 900 according to a fourth embodiment of the invention is shown in FIG. 9. Such an antenna 900 includes the conventional two-resonator PIFA 300 and a first additional radiating strip 910 or the like resonant structure. The first additional radiating strip 910 includes two rectilinear segments 910*a* and 910*b* which are at right angles to each other in which the first rectilinear segment 910*a* is directly connected to the feed strip 316 and preferably is lying on the plane on which the feed strip 316 lies and generally perpendicular to the folded radiating patch 310 and the ground plane 312. The second rectilinear segment 910*b* however extends from the first rectilinear segment 910*a* and folds around the side of the three-resonator antenna 900. The first additional radiating strip 910 behaves like an inverted-F antenna (IFA) and is tuned to have a second high resonance frequency, such as 1900 MHz. The second high resonance frequency is mainly determined or influenced by the length of the first additional radiating strip 910 measured from the point to which the first additional radiating strip 410 is connected to the feed strip 316 to the free end of the first additional radiating strip 910, which length corresponds to one quarter of a wavelength at the second high resonance frequency.

Figure 10:
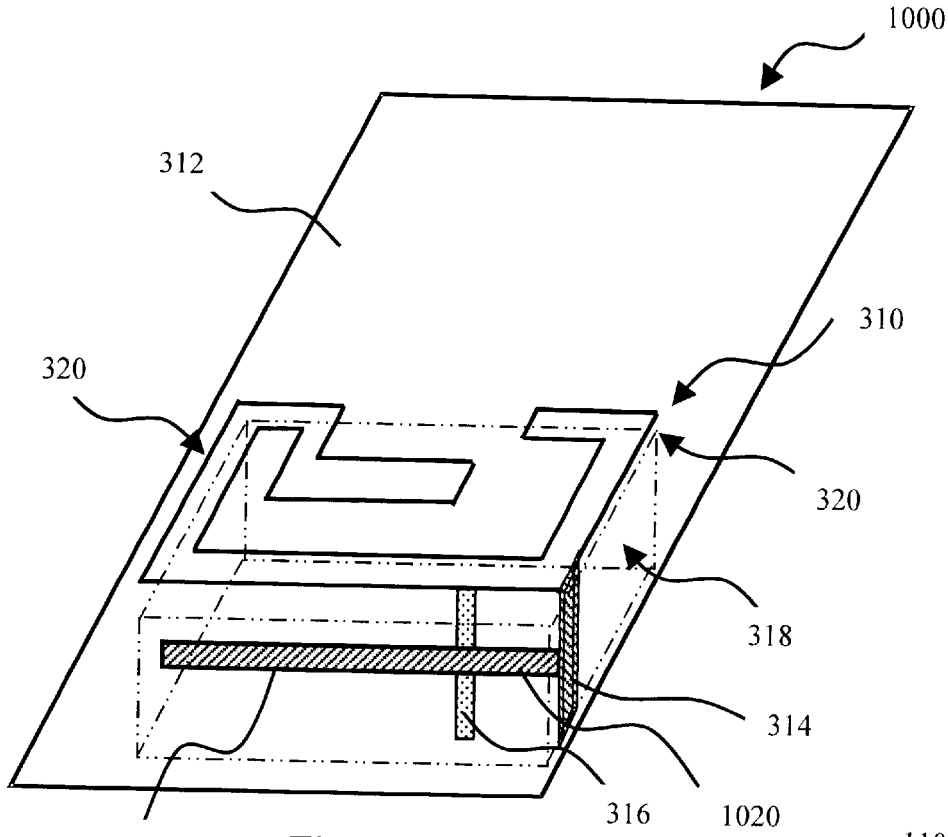

A three-resonator antenna 1000 according to a fifth embodiment of the invention is shown in FIG. 10. Such an antenna 1000 includes the conventional two-resonator PIFA 300 and a first additional radiating strip 1010 or the like resonant structure. The first additional radiating strip 1010 is directly connected to the feed strip 316 and the short-circuit strip 314 and preferably is lying on the plane on which the feed strip 316 lies and generally perpendicular to the folded radiating patch 310 and the ground plane 312. The first additional radiating strip 1010 behaves like an inverted-F antenna (IFA) and is tuned to have a second high resonance frequency, such as 1900 MHz. The second high resonance frequency is mainly determined or influenced by the length of the first additional radiating strip 910 measured from the point to which the first additional radiating strip 1010 is connected to the feed strip 316 to the free end of the first additional radiating strip 1010, which length corresponds to one quarter of a wavelength at the second high resonance frequency. A portion 1020 of the first additional radiating strip 1010 between the feed strip 316 and the short circuit strip 314 can be used to tune the three-resonator antenna 1000, thus providing one more degree of freedom for tuning the three-resonator antenna 1000.

Figure 11:
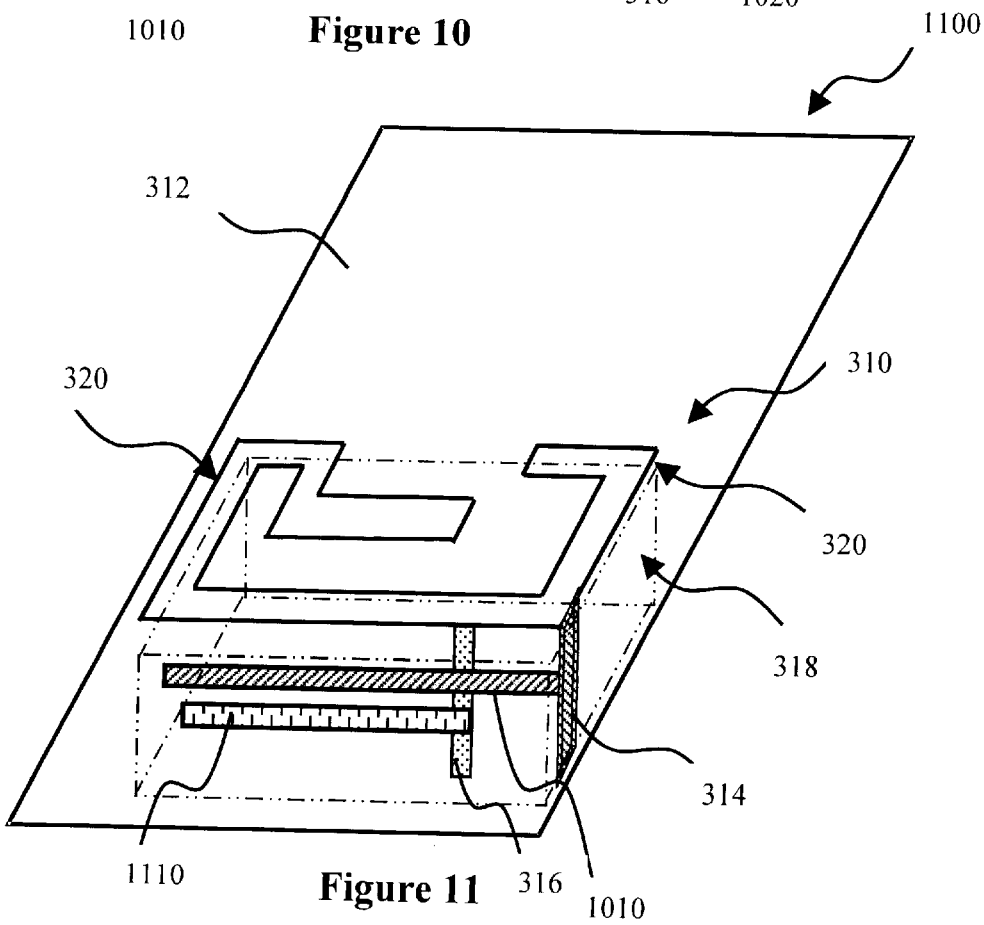

FIG. 11 shows a four-resonator antenna 1100 according to a sixth embodiment of the invention for five-band operation by adding a first additional radiating strip 1010 and a second additional radiating strip 1110 and connecting these to the feed strip 316. Such an antenna 1100 includes the conventional two-resonator PIFA 300, the first additional radiating strip 1010 or the like resonant structure, and the second additional radiating strip 1110 or the like resonant structure. The first additional radiating strip 1010 is directly connected to the feed strip 316 and the short-circuit strip 314 and preferably is rectilinear lying on the plane on which the feed strip 316 lies and generally perpendicular to the folded radiating patch 310 and the ground plane 312. Similarly, the second additional radiating strip 1110 is directly connected to the feed strip 316 and preferably is rectilinear lying on the plane on which the feed strip 316 lies. The four-resonator antenna 1100 can have an advantage in size reduction over the conventional antenna designs. The second additional radiating strip 1110 behaves like an inverted-F antenna (IFA) and is tuned to have a third high resonance frequency, such as 2450 MHz. The third high resonance frequency is mainly determined or influenced by the length of the second additional radiating strip 1110 measured from the point to which the second additional radiating strip 1110 is connected to the feed strip 316 to the free end of the second additional radiating strip 1110, which length corresponds to one quarter of a wavelength at the third high resonance frequency.

Figure 12:
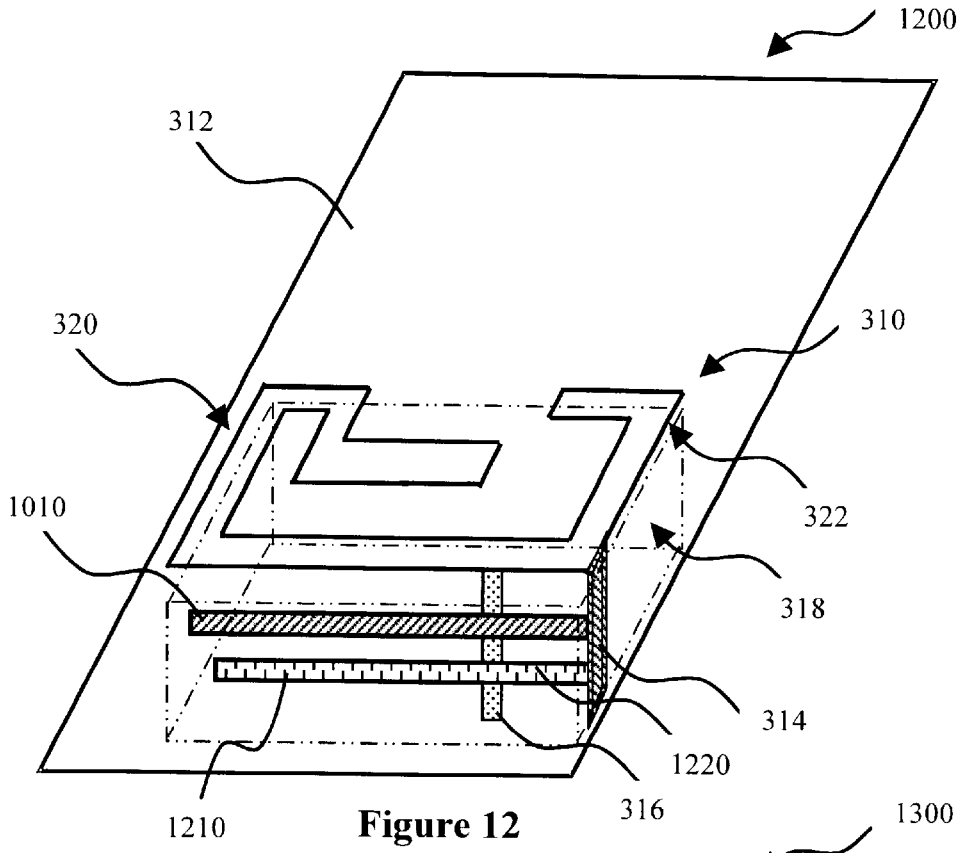

FIG. 12 shows a four-resonator antenna 1200 according to a seventh embodiment of the invention for five-band operation by adding the first additional radiating strip 1010 and a second additional radiating strip 1210 and connecting these to the feed strip 316. Such an antenna 1200 includes the conventional two-resonator PIFA 300, the first additional radiating strip 1010 or the like resonant structure, and the second additional radiating strip 1210 or the like resonant structure. The first additional radiating strip 1010 is directly connected to the feed strip 316 and the short-circuit strip 314 and preferably is rectilinear lying on the plane on which the feed strip 316 lies and generally perpendicular to the folded radiating patch 310 and the ground plane 312. Similarly, the second additional radiating strip 1210 is directly connected to the feed strip 316 and the short-circuit strip 314 and preferably is rectilinear lying on the plane on which the feed strip 316 lies. The four-resonator antenna 1200 can have an advantage in size reduction over the conventional antenna designs. The second additional radiating strip 1210 behaves like an inverted-F antenna (IFA) and is tuned to have a third high resonance frequency, such as 2450 MHz. The third high resonance frequency is mainly determined or influenced by the length of the second additional radiating strip 1210 measured from the point to which the second additional radiating strip 1210 is connected to the feed strip 316 to the free end of the second additional radiating strip 1210, which length corresponds to one quarter of a wavelength at the third high resonance frequency. A portion 1220 of the second additional radiating strip 1210 between the feed strip 316 and the short circuit strip 314 can be used to tune the four-resonator antenna 1200, thus providing one more degree of freedom for tuning the four-resonator antenna 1200.

Figure 13:
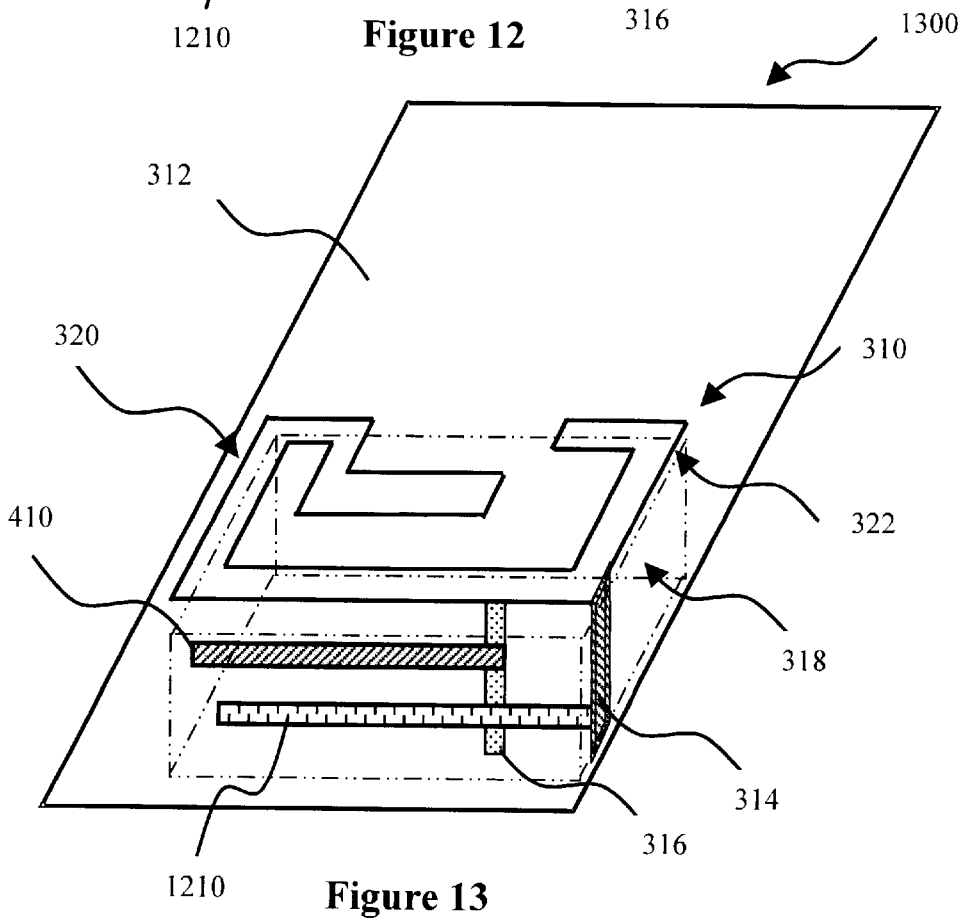

FIG. 13 shows a four-resonator antenna 1300 according to an eighth embodiment of the invention for five-band operation by adding the first additional radiating strip 410 and a second additional radiating strip 1210 and connecting these to the feed strip 316. Such an antenna 1300 includes the conventional two-resonator PIFA 300, the first additional radiating strip 410 or the like resonant structure, and the second additional radiating strip 1210 or the like resonant structure. The first additional radiating strip 410 is directly connected to the feed strip 316 and preferably is rectilinear lying on the plane on which the feed strip 316 lies and generally perpendicular to the folded radiating patch 310 and the ground plane 312. Similarly, the second additional radiating strip 1210 is directly connected to the feed strip 316 and the short-circuit strip 314 and preferably is rectilinear lying on the plane on which the feed strip 316 lies. The four-resonator antenna 1300 can have an advantage in size reduction over the conventional antenna designs. The second additional radiating strip 1210 behaves like an inverted-F antenna (IFA) and is tuned to have a third high resonance frequency, such as 2450 MHz. The third high resonance frequency is mainly determined or influenced by the length of the second additional radiating strip 1210 measured from the point to which the second additional radiating strip 1210 is connected to the feed strip 316 to the free end of the second additional radiating strip 1210, which length corresponds to one quarter of a wavelength at the third high resonance frequency.

When used in a mobile phone, the active portions of an embodiment antenna may be placed close to the inner side of a housing wall of the mobile phone or even fixed or secured thereto, such as by gluing. In such cases the dielectric properties of the housing material and their influence on the functioning of the embodiment antenna should be taken into account.

In accordance with embodiments of the invention the antenna also has a second high band portion in the form of a second conductor portion with its plane lying in the periphery perpendicular to the PCB and the main radiator plane. The second conductor portion shares the same grounding point and feeding point as the first conductor portion. Thus the second high band portion is like an inverted-F antenna (IFA). The second high band portion of the antenna is tuned to have a second high resonance frequency, such as 1900 MHz, and predefined bandwidth to define a second high frequency band. The second high resonance frequency is mainly determined or influenced by the length of the second conductor portion, which corresponds to one quarter of a wavelength at the second high frequency.

In the alternative, the first high band portion of the antenna can be tuned to the higher one of the two high band resonance frequencies—here 1900 MHz, and the second high band portion of the antenna can be tuned to the lower one of the two high band resonance frequencies—here 1800 MHz.

In FIG. 4 it is seen most clearly that the main radiator of the antenna are spaced from the PCB. In the space between the main radiator of the antenna and the PCB there is a dielectric substrate with physical dimensions and specific dielectric properties selected for the proper functioning of the antenna.

In the foregoing manner, miniature built-in multiple frequency band antennas are described. Although only a number of embodiments of the invention are disclosed, it will be apparent to one skilled in the art in view of this disclosure that numerous changes and/or modification can be made without departing from the scope and spirit of the invention.

What is claimed is:

1. A multiple frequency band antenna comprising:

a first resonant portion tuned to a low frequency band;

a second resonant portion tuned to a first high frequency band at frequencies higher than the low frequency band;

a third resonant portion tuned to a second high frequency band at frequencies higher than the low frequency band and substantially different from the first high frequency band; and a first conductor portion forming part of the first resonant portion and the second resonant portion, the first conductor portion having a grounding point, a feeding point for providing an input signal to at least one of the first resonant portion and the second resonant portion and for receiving an output signal from at least one of the first resonant portion and the second resonant portion, and a second conductor portion electrically connected to the feeding point wherein the third resonant portion is electrically connected to the second conductor portion.

2. The antenna as in claim 1, further comprising a third conductor portion electrically connected to the grounding point.

3. The antenna as in claim 2, wherein the third resonant portion is electrically connected to the third conductor portion.

4. The antenna as in claim 2, wherein the third conductor portion is electrically connected to a ground plane.

5. The antenna as in claim 4, wherein the third resonant portion is interspersed with the first conductor portion and the ground plane.

6. The antenna as in claim 4, wherein the first conductor portion, the first resonant portion and the second resonant portion are substantially coplanar.

7. The antenna as in claim 6, wherein the first conductor portion, the first resonant portion and the second resonant portion are substantially parallel to the ground plane.

8. The antenna as in claim 7, wherein the first conductor portion is rectilinear.

9. The antenna as in claim 8, wherein the first resonant portion is formed from a first plurality of rectilinear segments, each of the first plurality of rectilinear segments being substantially orthogonally concatenated to another of the first plurality of rectilinear segments.

10. The antenna as in claim 9, wherein the collective length of the first plurality of rectilinear segments is substantially equal to a quarter wavelength of the centre frequency of the low frequency band.

11. The antenna as in claim 10, wherein the second resonant portion is formed from a second plurality of rectilinear segments, each of the second plurality of rectilinear segments being substantially orthogonally concatenated to another of the second plurality of the rectilinear segments.

12. The antenna as in claim 11, wherein the collective length of the second plurality of rectilinear segments is substantially equal to a quarter wavelength of the centre frequency of the first high frequency band.

13. The antenna as in claim 12, wherein the first plurality of rectilinear segments and the second plurality of rectilinear segments are disposed on the same side of the longitudinal axis of the first conductor portion.

14. The antenna as in claim 13, wherein the feeding point is disposed on the side of the longitudinal axis opposite the first plurality of rectilinear segments and the second plurality of rectilinear segments.

15. The antenna as in claim 13, wherein the second conductor portion is rectilinear.

16. The antenna as in claim 15, wherein the planarity of the second conductor portion is substantially orthogonal with respect to the planarity of the first conductor portion and the planarity of the ground plane.

17. The antenna as in claim 14, wherein the third resonant portion is rectilinear and the length of the third resonant portion if substantially equal to a quarter wavelength of the centre frequency of the second high frequency band.

18. The antenna as in claim 17, wherein the third resonant portion is substantially orthogonally disposed with respect to the second conductor portion.

19. The antenna as in claim 2, further comprising a fourth resonant portion tuned to a third high frequency band at frequencies higher than the low frequency band and substantially different from the first high frequency band and the second high frequency band.

20. The antenna as in claim 19, wherein the fourth resonant portion is electrically connected to the third conductor portion.

21. The antenna as in claim 2, further comprising a dielectric substrate stacked between the first conductor portion, the first resonant portion and the second resonant portion and the ground plane.

* * * * *